United States Patent [19]

Aronne

[11] Patent Number: 5,072,457

[45] Date of Patent: Dec. 17, 1991

[54] CUSTOM-FITTED HARNESS FOR AN AVIATOR

[75] Inventor: Armand J. Aronne, Massapequa, N.Y.

[73] Assignee: Grumman Aerospace Corporation, Bethpage, N.Y.

[21] Appl. No.: 534,949

[22] Filed: Jun. 8, 1990

[51] Int. Cl.[5] ..... A41D 1/04

[52] U.S. Cl. ..... 2/102; 2/94; 2/243 R; 244/143

[58] Field of Search ..... 2/243 R, 102, DIG. 6, 2/2, 44, 69, 94, 243 B; 244/151 R, 143, 141, 148

[56] References Cited

U.S. PATENT DOCUMENTS

| | | | |
|---|---|---|---|
| 1,448,101 | 3/1923 | Wilson | 244/143 |
| 1,845,099 | 2/1932 | Popelákova et al. | 244/143 |
| 2,052,684 | 9/1936 | Wisbrod | 2/102 |
| 2,076,076 | 4/1937 | Dunlop | 2/102 |
| 2,256,597 | 9/1941 | Quilter et al. | 244/143 |
| 2,331,727 | 10/1943 | Quilter et al. | 244/143 |
| 2,382,816 | 8/1945 | Quilter et al. | 244/143 |
| 2,464,719 | 3/1949 | Quilter | 244/151 R |
| 2,887,286 | 5/1959 | Moran | 244/151 |
| 3,409,007 | 11/1968 | Fuller | 2/102 |
| 4,637,076 | 1/1987 | Tartt et al. | 2/102 |

FOREIGN PATENT DOCUMENTS

| | | | |
|---|---|---|---|
| 4607 | of 1915 | United Kingdom | 2/102 |

OTHER PUBLICATIONS

Gershman, Maurice, "Self Adhering Nylon Tapes," *Journal of AMA*, vol. 168, No. 7, Oct. 18, 1958.

*Primary Examiner*—Werner H. Schroeder
*Assistant Examiner*—Amy Brooke Vanatta
*Attorney, Agent, or Firm*—Pollock, Vande Sande & Priddy

[57] ABSTRACT

The harness of a pilot may be custom fitted in the field by temporarily fitting front and back vest panels. The vest includes strips pre-sewn thereon which serve as passageways for harness straps. The straps are tightened and temporarily secured to the vest so as to closely conform to the torso of the pilot. The vest is then removed so that the front and back panels may be sewn together as well as the temporarily secured straps. The result is a harness/vest combination which will conform securely to the torso of a pilot.

4 Claims, 1 Drawing Sheet

CUSTOM-FITTED HARNESS FOR AN AVIATOR

FIELD OF THE INVENTION

The present invention relates to harnesses for aviators, and more particularly to such a harness capable of being custom fitted in the field.

BACKGROUND OF THE INVENTION

A pilot's harness, to which a parachute is attached, must be closely fitted to the individual. This is necessary to ensure a relatively even load distribution on the torso of the pilot when parachuting. Further, conformance of the harness to the torso of a pilot ensures a maximum control of the parachute by the pilot so as to minimize the likelihood of injury upon landing.

During the present time military pilots are offered a selection of ready-to-wear harnesses that have been prepared in up to 17 different sizes. In the field this presents a logistics problem since the harnesses must be continually stocked and the expense for each unit is considerable. A logistics improvement would be possible if a single harness kit could be made available so as to be simply fitted on an individual pilot and quickly assembled in the field so as to offer the close conforming fit available by current pre-made models without the disadvantage of carrying a large inventory.

BRIEF DESCRIPTION OF THE INVENTION

The present invention accomplishes this objective by offering front and back disassembled vest panels having harness strap sleeves sewn to the exterior thereof. The panels are temporarily fitted together by means of VELCRO or other suitable fasteners so as to conform in size with a particular pilot being fitted. Harness straps are then run through the strap sleeves and are then pulled temporarily tight to ensure maximum conformance with the torso of the pilot.

The affixed panels are then sewn together along the temporarily attached seams and the harness straps are sewn in place as well. The sewing procedure is easily accomplished in the field with a semi-skilled machine operator. Thus, the need for stocking a large number of ready-to-wear vests is avoided. As will be appreciated, the cost savings is considerable.

BRIEF DESCRIPTION OF THE FIGURES

The above-mentioned objects and advantages of the present invention will be more clearly understood when considered in conjunction with the accompanying drawings, in which.

DETAILED DESCRIPTION OF THE INVENTION

Figure 1:
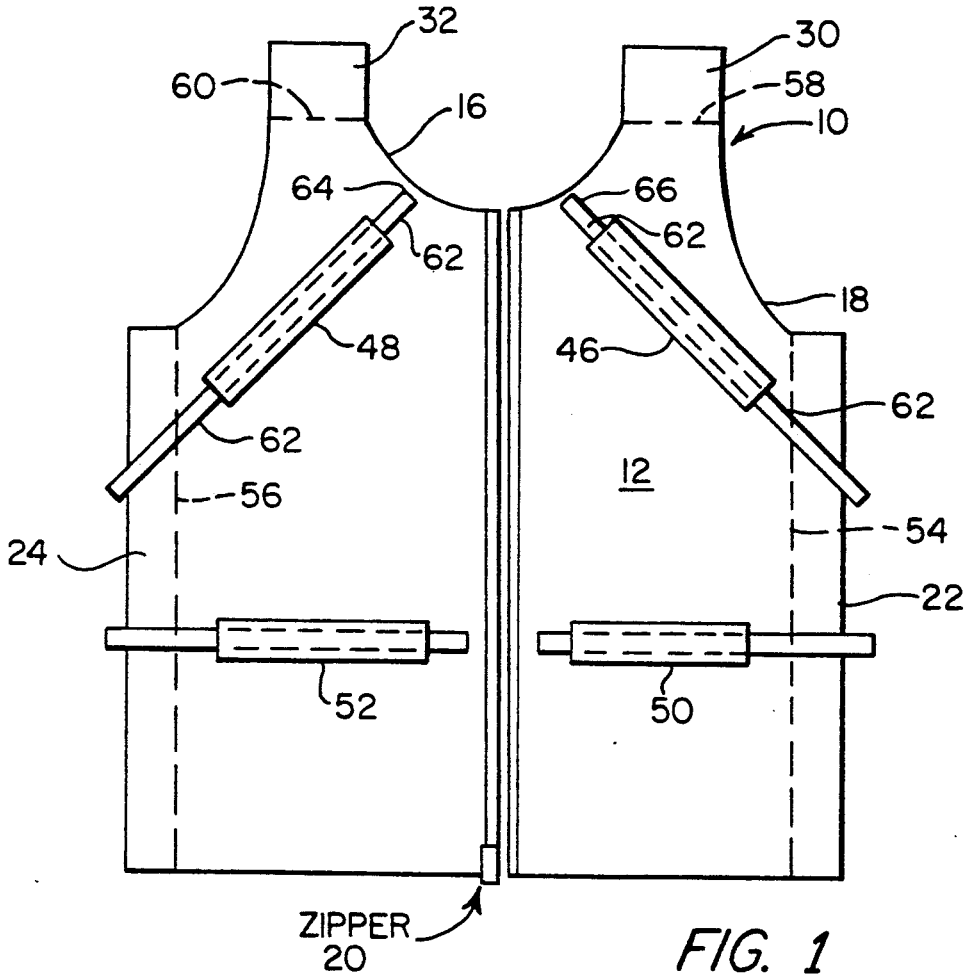
FIG. 1 is an elevational view of the vest in accordance with the present invention.
Figure 2:
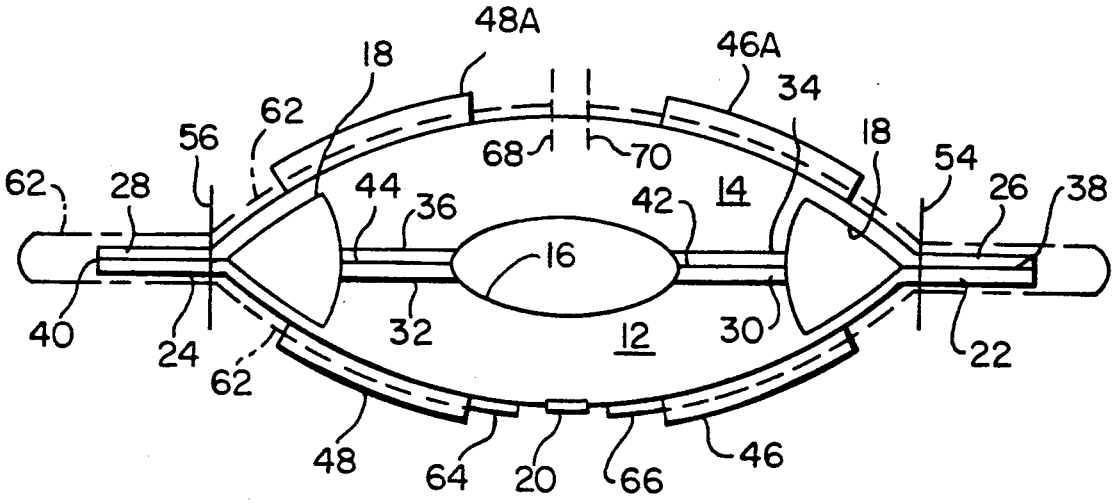
FIG. 2 is a top plan view of the vest.

A vest in accordance with the present invention is shown in FIG. 1 by reference numeral 10. In the figure the vest is shown temporarily assembled at a front panel 12 and a back panel 14, as indicated in FIG. 2. The condition of the vest illustrated in the figures would be as shown after being fitted on a pilot. The panels are cut so that an opened neck 16 exists along with opened arm holes 18. The vest could, of course, be provided with full-length sleeves or zip-on sleeves. A zipper 20 divides the front panel 12 so as to permit a pilot to put on and remove the vest, easily.

The vest as shown includes side flaps 22 and 24 along the side edges of the front panel 12; and flaps 26 and 28 appear along the sides of back panel 14. The flaps 22 and 26 are temporarily held together by interfacing VELCRO strips 38. Similarly, a VELCRO strip 40 temporarily secures flaps 24 and 28. Although VELCRO has been described, other types of suitable fasteners may be employed, such as staples or pins.

The upper section of the vest also includes temporarily attached shoulder flaps. In the front panel 12 there are flaps 30 and 32 while in the back panel 14 there are flaps 34 and 36. The flaps 30 and 34 may be secured together by means of a suitable VELCRO interface as shown by reference numeral 42, while the top flaps 32 and 36 may likewise be held together with a VELCRO interface at 44. After the flaps have been suitably pressed together at positions that will ensure a snug yet comfortable fit for a pilot, the zipper 20 is opened and the pilot removes the vest. Then, the VELCRO-secured flaps along the sides and the top are sewn for permanent securement. The side seams are indicated by reference numerals 54 and 56 while the top seams are indicated by reference numerals 58 and 60. In the figures, the side and top flaps are shown to extend outwardly thereby possibly requiring them to be cut. Although this is not an optimal solution, it is shown and described for purposes of expediting an understanding of the present invention. In a preferred embodiment of the invention, it would be preferable to have the flaps of one of the panels, for example the front panel, inwardly underlying the corresponding flaps of the outer panel. In this way the panels could be sewn together and present a neat finished product without requiring cutting.

In order to fabricate a true harness from the vest, harness straps must be attached so that close conformance to the torso of a pilot is achieved. In this connection, strips 46 and 48 are pre-sewn to the front panel 12 of the vest and form sleeves. Similarly, strips 50 and 52 may be pre-sewn on a lower portion of the front and back vest panels. These strips form passageways for harness straps that are loosely pulled therethrough during initial fitting on a pilot. These harness straps are indicated as 62 through upper strips 46, 48, and rear strips 46A, 48A. Within strip 48 the harness strap 62 is seen to be temporarily attached at end 64 while the strap 62 is threaded through the remaining passageways formed by the remaining strips. However, it is to be emphasized that the strips shown in the figures are illustrative and simplified. An actual harness strap configuration is usually more elaborate and the lacing patterns thereof are well known in the prior art. However, with the present invention, a sufficient number of strips are appropriately pre-sewn to the vest so that a harness strap 62 may duplicate the lacing pattern of a conventional harness. After the harness strap has been laced through all of the passageways of the vest, they may be pulled tightly around the torso of a pilot and temporarily retained by pins, staples, or VELCRO strips. After removal from the torso of the pilot, the harness straps may be sewn at appropriate ends such as 68, 70, 64, and 66 for the upper illustrated strips 46, 48, and 46A, 48A, as shown in FIG. 2.

Thus, after the vest is removed from the pilot, at the end of a fitting, the temporarily retained panels and harness straps are permanently sewn, thus resulting in a well-fitting harness/vest combination for the pilot. The sewing procedure can easily be performed on a sewing machine by a semi-skilled operator.

Accordingly, by utilizing the present invention, a storage problem is eliminated and cost savings may be realized.

It should be understood that the invention is not limited to the exact details of construction shown and described herein for obvious modifications will occur to persons skilled in the art.

I claim:

1. A method for creating a well-fitting pilot harness having at least one harness strap as well as front and rear panels, each of which includes side and shoulder edges, passageways formed on the panels for receiving the strap, the method comprising:

positioning front and rear vest panels along an individual to be fitted;

temporarily securing corresponding edges of both panels together in overlapping fashion to form a snug fit;

threading the harness strap through passageways located on the vest;

temporarily securing the strap to the vest;

removing the vest from the person being fitted;

permanently securing overlapping edges together;

sewing the strap in the passageways and to the vest.

2. A pilot harness adaptable for a wide range of sizes comprising:

a front vest panel having side and shoulder edges, and having flaps extending outwardly from the side and shoulder edges;

a back vest panel having side and shoulder edges, and having flaps corresponding to those of the front panel and extending outwardly from the side and shoulder edges of the back panel;

means for removably securing preselected areas of the respective side and shoulder flaps together to create a vest adapted to fit various torso sizes, a plurality of strips of material secured along lateral edges thereof to the vest panels for creating passages through the strips;

at least one length of harness strap temporarily threaded through a preselected number of passages;

means passing through the respective removably secured side and shoulder flaps for permanently fastening these flaps together;

means passing through the strips and the enclosed strap for permanently fastening the strap relative to the vest; and a central closure means located in the vest for enabling the vest to be easily put on and taken off.

3. The structure set forth in claim 2 wherein the means passing through the respective removably secured side and shoulder flaps for permanently fastening these flaps together are tautly sewn seams.

4. The structure set forth in claim 2 wherein the means passing through the strips and the at least one threaded strap includes tautly sewn stitches passing through each of the strips, the strap, and a corresponding vest panel.

* * * * *